United States Patent [19]

Mauvernay et al.

[11] 4,011,960

[45] Mar. 15, 1977

[54] SECURITY SCREW CAP

[75] Inventors: Yves Mauvernay, Riom, France; Franz Zberg, Fribourg, Switzerland

[73] Assignee: S.A.S. Trading S.A., Switzerland

[22] Filed: Apr. 30, 1976

[21] Appl. No.: 682,097

[30] Foreign Application Priority Data

July 11, 1975 Switzerland ..... 9130/75

[52] U.S. Cl. ..... 215/220

[51] Int. Cl.[2] ..... B65D 55/02; B65D 85/56; A61J 1/00

[58] Field of Search ..... 215/206, 220, 221, 224

[56] References Cited

UNITED STATES PATENTS

| | | | |
|---|---|---|---|
| 2,531,008 | 9/1970 | Achalal et al. | 215/220 |
| 3,472,411 | 10/1969 | Turner | 215/220 |

*Primary Examiner*—George T. Hall

*Attorney, Agent, or Firm*—Bucknam and Archer

[57] ABSTRACT

A security screw cap has a closed internally screw-threaded inner cap or sleeve clipped in an outer actuating sleeve which has two axial position, a pulled-out security position in which it rotates freely and a pushed-in actuating position in which a keyhole-shaped profile on top of the inner sleeve engages in a keyhole-shaped opening in the top of the outer sleeve.

9 Claims, 7 Drawing Figures

Fig. 5
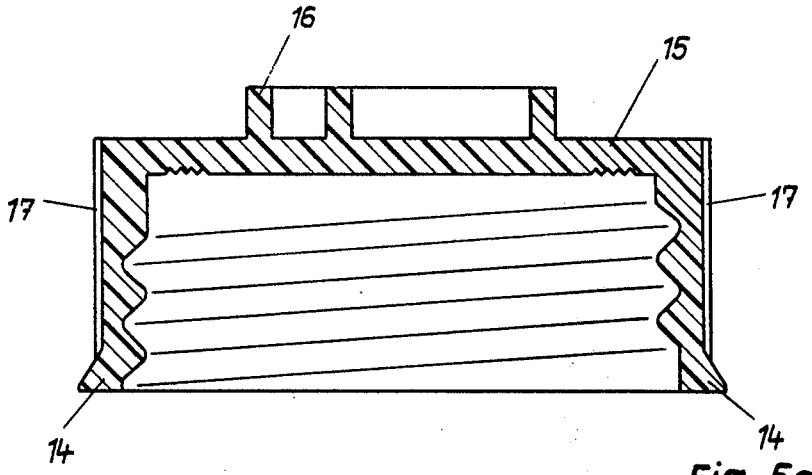
Fig. 5a
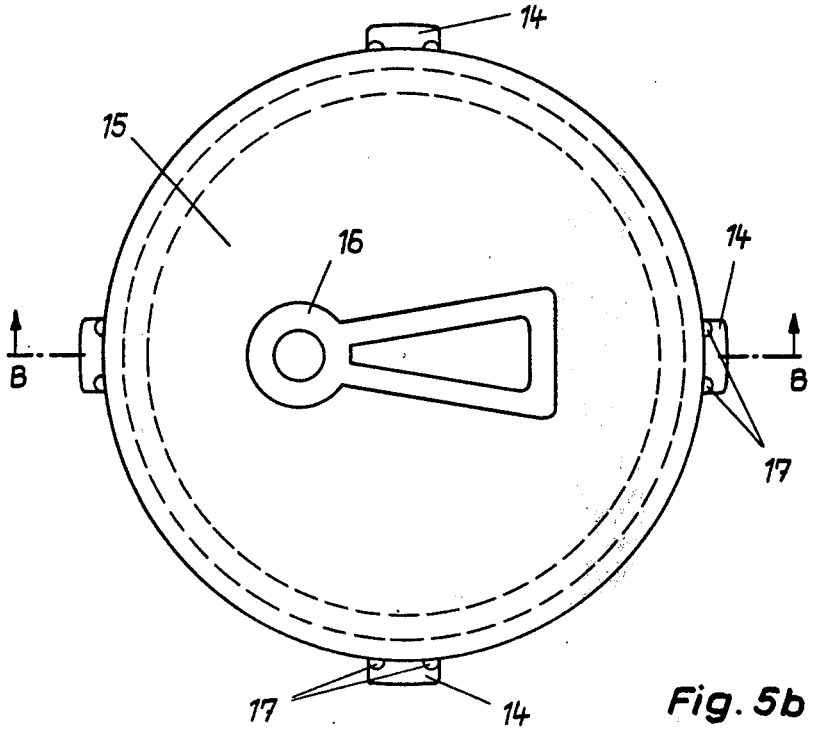
Fig. 5b

SECURITY SCREW CAP

The invention relates to a screw cap with a security position for preventing young children from having access to the contents of receptacles when these include dangerous products such as medicaments, maintenance products and cleaning products, but which may be used as a normal screw cap when the receptacles are handled by persons who do not have young children, or by aged persons who do not have the aptitude to carry out special manipulations to open the receptacle.

The prior art security screw caps have reached such a degree of complexity that very few models are in fact manufactured because of the high cost price and the possible inhibition of purchase. In effect, manufactures of various potentially dangerous products hesitate to place such stoppers on their receptacles since they known that an appreciable fraction of the purchasers will be put off their product because they have no young children or because they do not have the necessary physical aptitude to carry out a succession of manipulations requiring force and precision.

An object of the invention is to remedy the various stated drawbacks by providing a security screw cap which can be used at will normally, or with a security device brought into play and in which the operation of disabling the security device is not associated with the operation of unscrewing and removing the cap.

According to the invention, such a screw cap comprises a first internally threaded sleeve having an upper part closed by a disc including on its upper surface a contour in relief, and having on a lower part of its outer wall a plurality of regularly spaced abutments. The screw cap further comprises a second, external sleeve having an upper disc including means defining a complementary recess to said contour in relief of the first sleeve. The inner surface of the wall of the second sleeve has (a) at its lower part a continuous rim cooperating with said abutments of the first sleeve to hold it clipped in the second sleeve, (b) at its upper part a plurality of guide ribs allowing free rotation of the second sleeve on the first sleeve and (c), between said ribs and said rim, two continuous circular grooves for selectively receiving said abutments, Said grooves are separated by a distance such that when said abutments are engaged in the groove nearest said rim said contour in relief is located below the plane of the disc of the outer sleeve to provide a security position allowing free rotation of the outer sleeve in both directions and when said abutments are brought into the groove furthest away from said rim by a pressure on the second sleeve after previously positioning it to bring said contour in relief to face said complementary recess the outer sleeve is fixed to the inner sleeve by engagement of said contour in relief in said complementary recess. The two sleeves are able to remain in this latter position to allow a normal use of the screw cap, or may be returned into said security position, after screwing the first sleeve onto a receptacle, by simply pulling on the second sleeve.

In a preferred embodiment of the invention, said complementary recess is an opening and said contour in relief is keyhole-shaped and is coloured differently to the second sleeve, to provide a visual indication to the user that the screw cap can be unscrewed only when said keyhole-shaped contour is fully visible. In this embodiment, there is only a single position in which the two sleeves can be locked together. The same result could be obtained if the keyhole-shape were replaced by an arrow shape, or another shape with a single axis of symmetry.

In another embodiment, said upper disc of said second sleeve forms a closed wall closing off said complementary recess. In this case, the bringing of the sleeves to the engaging position is achieved by slowly turning the outer sleeve while exerting a slight pressure until the user feels the contour in relief fit in the recess.

It is possible, within the scope of the invention, to provide contours in relief with a number *n* axes of symmetry and allowing engagement of the two sleeves in *n* positions : two for rectangular contours; three for contours formed by 3-pointed stars and isoceles triangles; four for square or cross-shaped contours, and so on. In the second type of embodiment (closed recess) it would be advantageous to have a greater number of locking positions, whereas a single locking position is adequate for embodiments in which the recess is an opening.

In order to permit an easy free rotation of the outer sleeve on the inner one in the security position, the only contacting parts of the two sleeves correspond to the guide ribs at the upper part of the inner wall of the outer sleeve. If the materials used are of low mechanical strength, of if large torques are required for unscrewing and unscrewing, pairs of reinforcing ribs can be disposed on the outer wall of the inner sleeve, to rest on either side of the guide ribs to consolidate the locking action of the interengaging contour and recess.

An embodiment of the invention is shown by way of example in the accompanying drawings, in which:

FIG. 5 shows a varied form of inner sleeve with reinforcing ribs, shown in FIG. 5*a* as a cross-section along line B—B of FIG. 5*b* and in top plan view in FIG. 5*b*.

Figure 1:
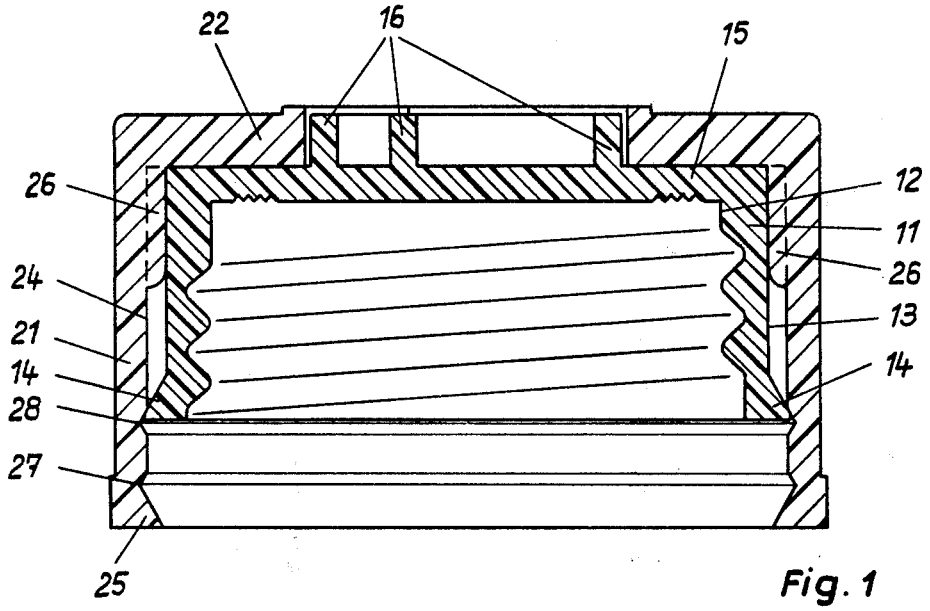
FIG. 1 is a cross-section along line A—A of FIG. 3, of a screw cap in a position in which it operates normally.
Figure 2:
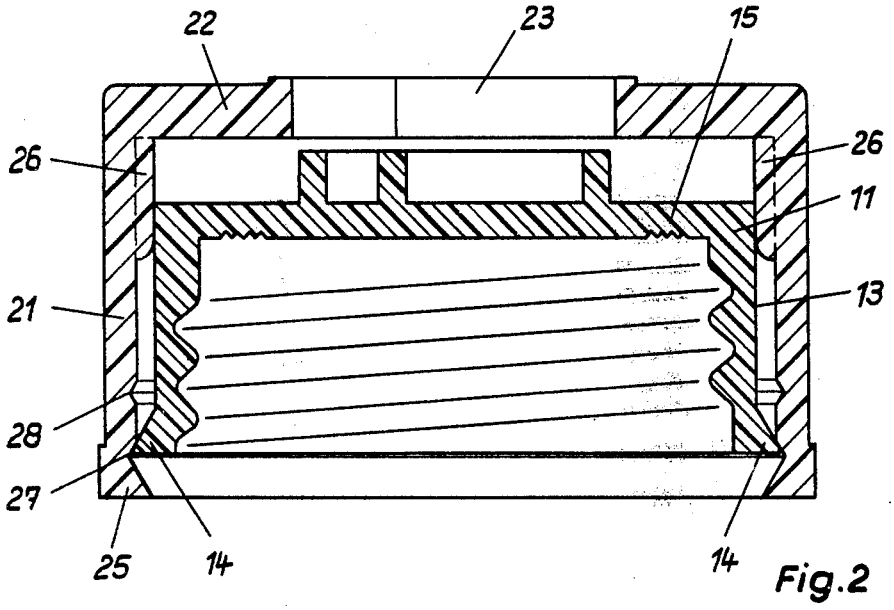
FIG. 2 is a similar cross-section showing the screw cap in a security position.
Figure 3:
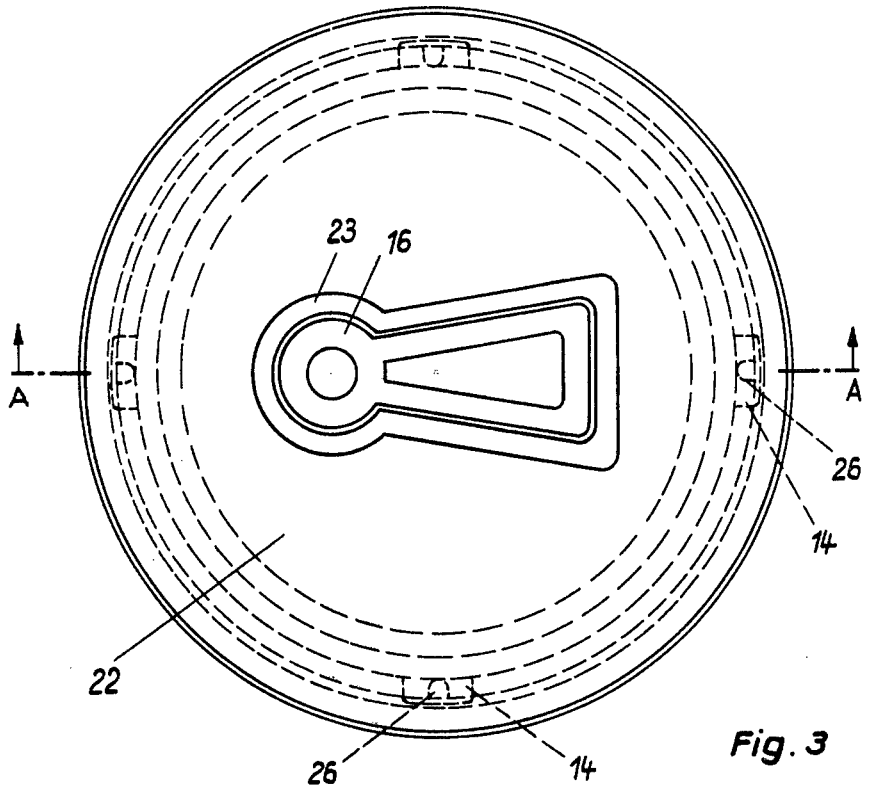
FIG. 3 is a top plan view of the screw cap in the security position.
Figure 4:
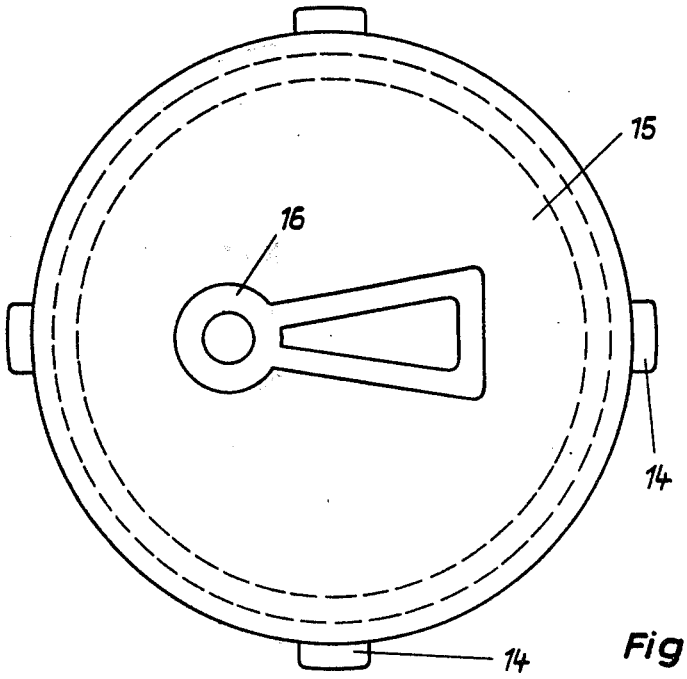
FIG. 4 is a top plan view of an inner sleeve of the screw cap.

The screwcap comprises an inner cap or sleeve 11 having a threaded inner annular wall 12 by which it is screwed on the neck of a bottle. Its outer annular wall 13 has, at its lower end, several regularly-spaced abutments 14. Its upper end is closed by a disc 15 carrying on its outer face a keyhole-shaped contour in relief 16. In the embodiments of FIGS. 1 to 5, there are four equi-spaced abutments 14; however, there could be a different number.

An outer cap or sleeve 21 is slidably mounted on sleeve 11. Sleeve 21 has an upper disc 22 with an opening 23 of complementary keyhole shape to the contour in relief 16 of sleeve 11.

The inner wall 24 of sleeve 21 has, at its lower end, a continuous bulge or rim 25 cooperating with the abutments 14 of sleeve 11 to hold the latter clipped in sleeve 21. At its upper part, wall 24 has guide ribs which to provide a contacting fit between the smooth, cylindrical outer wall of sleeve 11 and the inside of sleeve 21. In the illustrated embodiment, there are four equispaced ribs 26, but there could be a different number. Between the ribs 26 and rim 25, wall 24 has two continuous circular grooves 27 and 28 for selectively receiving the abutments 14 of sleeve 11. When the abutments 14 engage in groove 27, the screw cap is in a security position (FIG. 2) and when they engage in groove 28, a normal position (FIG. 1).

FIG. 5 shows pairs of reinforcing ribs 17 on the outer wall of the inner sleeve The ribs 17 extend on either side of the guide ribs 26 on the inner wall of sleeve 21 when the complementary profile 16 and opening 23 face one another. In the variation of FIG. 5, there are four pairs of ribs 17. However, there could be the same number of pairs of ribs 17 as there are guide ribs 26.

When the screw cap is in the normal position (FIG. 1), it can be screwed and unscrewed in the manner of an ordinary screw cap. To place the screw cap in the security position (FIG. 2), it is necessary to pull the outer sleeve 21 upwards until the abutments 14 engage in groove 27. The accessible outer sleeve 21 of the screw cap is then free to rotate in either direction, with a slight friction when the inner sleeve is provided according to FIG. 5.

To unscrew the cap when it is in the security position, it is necessary to place the interengaging profiles (16, 23) facing one another and to exert a downward pressure on the outer sleeve 21 until the abutments 14 come to engage in the groove 28. The cap can then be unscrewed in the normal manner.

With the form of inner sleeve of FIG. 5, the guide ribs of the outer sleeve cooperate with the pairs of reinforcing ribs 17 to consolidate the action of the interengaging profiles.

At least one of the sleeves, preferably the outer one, is of a thermoplastic material, for example polypropylene. The inner sleeve may be of metal or a thermo-setting resin, but in this instance a sealing joint should be provided between the inner sleeve and the neck of the bottle. Preferably, the two sleeves are in a thermoplastic material.

What is claimed is:

1. A security screw cap for receptacles for preventing access to dangerous products that may be contained therein by children but which may be used by adults as a normal screw cap, comprising:

a first internally threaded sleeve having an upper part closed by a disc including on it upper surface a contour in relief, and having on a lower part of its outer wall a plurality of regularly spaced abutments; and a second, external sleeve having an upper disc including means defining a complementary recess to said contour in relief of the first sleeve, and the inner surface of the wall of which has (a) at its lower part a continuous rim cooperating with said abutments of the first sleeve to hold it clipped in the second sleeve, (b) at its upper part a plurality of guide ribs allowing free rotation of the second sleeve on the first sleeve and (c), between said ribs and said rim, two continuous circular grooves for selectively receiving said abutments, said grooves being separated by a distance such that when said abutments are engaged in the groove nearest said rim said contour in relief is located below the plane of the disc of the second sleeve to provide a security position allowing free rotation of the second sleeve in both directions and when said abutments are brought into the groove furthest away from said rim by a pressure on the second sleeve after previously positioning it to bring said contour in relief to face said complementary recess the second sleeve is fixed to the first sleeve by engagement of said contour in relief in said complementary recess, the two sleeves being able to remain in this position to allow a normal use of the screw cap, or to be returned into said security position, after screwing the first sleeve onto a receptacle, by simply pulling on the second sleeve.

2. Screw cap according to claim 1, in which said complementary recess of said second sleeve is an opening.

3. Screw cap according to claim 1, in which said upper disc of said second sleeve forms a closed wall closing off said complementary recess.

4. Screw cap according to claim 2, in which said contour in relief has a single axis of symmetry.

5. Screw cap according to claim 4, in which said contour in relief is keyhole-shaped and coloured differently to the second sleeve, to provide a visual indication to the user that the screw cap can be unscrewed only when said keyhole-shaped contour is fully visible.

6. Screw cap according to claim 1, in which said contour in relief has $n$ axes of symmetry, where $n$ is a whole number greater than 1, hence permitting engagement of the two sleeves in $n$ different positions.

7. Screw cap according to claim 1, in which the outer wall of said first sleeve has pairs of reinforcing ribs disposed on either side of said guide ribs when said contour in relief and said complementary recess face one another, said guide ribs consolidating the locking action of said contour in relief and said complementary recess.

8. Screw cap according to claim 1, in which at least one of said sleeves is of a thermoplastic material.

9. Screw cap according to claim 8, in which said second sleeve is of thermoplastic material.

* * * * *